US005751903A

United States Patent [19]

Swaminathan et al.

[11] Patent Number: 5,751,903

[45] Date of Patent: May 12, 1998

[54] LOW RATE MULTI-MODE CELP CODEC THAT ENCODES LINE SPECTRAL FREQUENCIES UTILIZING AN OFFSET

[75] Inventors: Kumar Swaminathan, Gaithersburg; Murthy Vemuganti, Germantown, both of Md.

[73] Assignee: Hughes Electronics, Los Angeles, Calif.

[21] Appl. No.: 359,116

[22] Filed: Dec. 19, 1994

[51] Int. Cl.[6] ..... G10L 9/18

[52] U.S. Cl. ..... 395/2.39; 395/2.28; 395/2.29

[58] Field of Search ..... 395/2.28, 2.29, 395/2.3, 2.31, 2.32, 2.39, 2.17, 2.23

[56] References Cited

U.S. PATENT DOCUMENTS

| | | | |
|---|---|---|---|
| 5,046,099 | 9/1991 | Nishimura | 381/43 |
| 5,233,660 | 8/1993 | Chen | 381/38 |
| 5,293,449 | 3/1994 | Tzeng | 395/2.32 |
| 5,448,680 | 9/1995 | Kang et al. | 395/2.34 |
| 5,487,128 | 1/1996 | Ozawa | 395/2.31 |
| 5,495,555 | 2/1996 | Swaminathan | 395/2.16 |
| 5,513,297 | 4/1996 | Kleijn et al. | 395/2.32 |

OTHER PUBLICATIONS

Deller, "Discrete–Time Processing of Speech Signals," Prentice Hall, Upper Saddle River, NJ, pp. 430–431, Dec. 1993.

Marca, "An LSF Quantizer for the North–American Half–Rate Speech Coder," IEEE Transactions on Vehicular Technology, pp. 413–419, Sep. 1994.

Kuo et al., "Speech Classification Embedded in Adaptive Codebook Search for CELP Coding," IEEE ICASSP–93, pp. 147–150, Apr. 1993.

Muller, "A CODEC Candidate for the GSM Half Rate Speech Channel," IEEE ICASSP–94, pp. 257–260, Apr. 1994.

Wang, "Phonetically–Based Vector Excitation Coding of Speech at 3.6 kbps," IEEE ICASSP–89, pp. 49–52, May 1989.

Ozawa, "M–CELP Speech Coding at 4kbps," IEEE ICASSP–94, pp. 269–272, Apr. 1994.

Holmes, "Speech Synthesis and Recognition," Chapman and Hall, London, p. 60, 1988.

Gersho and Gray, "Vector Quantization and Signal Compression," Kluwer Academic Publishers, Norwell Massachusetts, pp. 487–503, 1992.

Yong et al., "Encoding of LPC Spectral Parameters Using Switched–Adaptive Interframe Vector Prediction," IEEE ICASSP'88, pp. 402–405, Apr. 1988.

*Primary Examiner*—Allen R. MacDonald
*Assistant Examiner*—Robert C. Mattson
*Attorney, Agent, or Firm*—John T. Whelan; Wanda Denson-Low

[57] ABSTRACT

The present invention provides a multi-mode CELP encoding and decoding method and device for digitized speech signals providing improvements over prior art codecs and coding methods by selectively utilizes backward prediction for the short-term predictor parameters and fixed codebook gain of a speech signal. In order to achieve these improvements, the present invention provides a coding method comprising the steps of classifying a segment of the digitized speech signal as one of a plurality of predetermined modes, determining a set of unquantized line spectral frequencies to represent the short term predictor parameters for that segment, and quantizing the determined set of unquantized line spectral frequencies using a mode-specific combination of scalar quantization and vector quantization, which utilizes backward prediction for modes with voiced speech signals. Furthermore, backward prediction is selectively applied to the fixed codebook gain in the modes that are free of transients so that it may be used in the fixed codebook search and fixed codebook gain quantization in those modes.

28 Claims, 16 Drawing Sheets

| PARAMETER DESCRIPTION | # BITS IN MODE A |
|---|---|
| MODE BIT 1 | 1 |
| DIFFERENTIAL LSF 1 OFFSET | 2 |
| DIFFERENTIAL LSF 2 OFFSET | 2 |
| DIFFERENTIAL LSF 3 OFFSET | 2 |
| DIFFERENTIAL LSF 4 OFFSET | 2 |
| DIFFERENTIAL LSF 5 OFFSET | 2 |
| DIFFERENTIAL LSF 6 OFFSET | 2 |
| DIRRERENTIAL LSF 7-10 VQ OFFSET | 5 |
| OPEN LOOP PITCH INDEX | 5 |
| ADAPTIVE CODEBOOK INDEX FOR EACH SUBFRAME | 5x6 = 30 |
| ADAPTIVE CODEBOOK GAIN INDEX FOR EACH SUBFRAME | 5x3 = 15 |
| SIGN OF FIXED CODEBOOK GAIN FOR EACH SUBFRAME | 5x1 = 5 |
| FIXED CODEBOOK INDEX FOR EACH SUBFRAME | 5x7 = 35 |
| FIXED CODEBOOK GAIN INDEX FOR EACH SUBFRAME | 5x4 = 20 |
| TOTAL NUMBER OF BITS PER 22.5 MSEC FRAME | 128 |

Figure 14

| PARAMETER DESCRIPTION | # BITS IN MODE B |
|---|---|
| MODE BIT 1 | 1 |
| LSF 1 INDEX | 4 |
| LSF 2 INDEX | 4 |
| LSF 3 INDEX | 4 |
| LSF 4 INDEX | 4 |
| LSF 5 INDEX | 4 |
| LSF 6 INDEX | 4 |
| VQ TABLE INDEX FOR LSFs 7 - 10 | 9 |
| IRS vs. FLAT INDICATION BIT | 1 |
| ADAPTIVE CODEBOOK INDEX FOR EACH SUBFRAME | 4x7 = 28 |
| ADAPTIVE CODEBOOK GAIN INDEX FOR EACH SUBFRAME | 4x3 = 12 |
| SIGN OF FIXED CODEBOOK GAIN FOR EACH SUBFRAME | 4x1 = 4 |
| FIXED CODEBOOK INDEX FOR EACH SUBFRAME | 4x8 = 32 |
| FIXED CODEBOOK GAIN INDEX FOR EACH SUBFRAME | 4x4 = 16 |
| MODE BIT 2 | 1 |
| TOTAL NUMBER OF BITS PER 22.5 MSEC FRAME | 128 |

Figure 15

| PARAMETER DESCRIPTION | # BITS IN MODE C |
|---|---|
| MODE BIT 1 | 1 |
| LSF 1 INDEX | 4 |
| LSF 2 INDEX | 4 |
| LSF 3 INDEX | 4 |
| LSF 4 INDEX | 4 |
| LSF 5 INDEX | 4 |
| LSF 6 INDEX | 4 |
| VQ TABLE INDEX FOR LSFs 7 - 10 | 9 |
| IRS vs. FLAT INDICATION BIT | 1 |
| ADAPTIVE CODEBOOK INDEX FOR EACH SUBFRAME | 4x7 = 28 |
| ADAPTIVE CODEBOOK GAIN INDEX FOR EACH SUBFRAME | 4x3 = 12 |
| SIGN OF ADAPTIVE CODEBOOK GAIN FOR EACH SUBFRAME | 4x1 = 4 |
| SIGN OF FIXED CODEBOOK GAIN FOR EACH SUBFRAME | 4x1 = 4 |
| FIXED CODEBOOK INDEX FOR EACH SUBFRAME | 4x7 = 28 |
| FIXED CODEBOOK GAIN INDEX FOR EACH SUBFRAME | 4x4 = 16 |
| MODE BIT 2 | 1 |
| TOTAL NUMBER OF BITS PER 22.5 MSEC FRAME | 128 |

Figure 16

LOW RATE MULTI-MODE CELP CODEC THAT ENCODES LINE SPECTRAL FREQUENCIES UTILIZING AN OFFSET

BACKGROUND OF THE INVENTION

With the increasing applications for speech processing in systems such as cellular communication and voice store and forward systems, there is a growing need for high-quality, efficient digitization of speech signals. Because digitized speech sounds can consume large amounts of signal bandwidths, many techniques have been developed in recent years for reducing the amount of information needed to transmit or store the speech signal in such a way that it can later be accurately reconstructed. These techniques have focused on creating a code system to permit the speech signal to be transmitted or stored in code, which can be decoded for later retrieval or reconstruction.

One modern technique is known as Code Excited Linear Predictive coding ("CELP"). A CELP coding system attempts to represent an input speech signal with parameters in such a way as to enable reconstruction of the signal with as little perceivable error from the input signal as possible.

Two primary sets of parameters used to represent a speech signal in CELP systems are known as the short-term predictor parameters and the excitation predictor parameters. The short-term predictor parameters refer to a filter which models the frequency shaping effects of the vocal tract for the analyzed signal.

The excitation parameters concern the excitation of the signal. Typical CELP systems represent the excitation of an input speech signal with vectors from two codebooks: an adaptive codebook contains the history of the excitation measured for earlier segments of the input signal, while a fixed codebook contains prestored waveform shapes capable of modeling a broad range of excitation signals. The adaptive codebook is what is sometimes referred to as the long-term predictor, and these parameters model the long-term periodicity of the input speech, if voiced, by reproducing the fundamental oscillating frequencies of the vocal chords.

In order to further reduce the amount of information required to encode a speech signal, a modified CELP system using backward prediction has been developed, enabling an input signal to be reconstructed in part by predicting the signal based on the received parameters and the reconstructed signal of the previously decoded frame. With selective application, backward prediction can greatly enhance the efficiency of speech transmission by reducing the amount of information that must be encoded for each transmitted signal without significantly affecting the accuracy of the signal reconstruction.

The International Telegraph and Telephone Consultative Committee ("CCITT"), an international communications standards organization, has adopted a low-delay 16 kbps speech coding and decoding ("codec") CELP-based universal standard. In order to achieve high quality performance, this standard heavily relies on the efficiency savings afforded by backward prediction for all speech parameters except the fixed codebook parameters. However, technology supporting this standard cannot be readily adapted to lower bit rates because high quality speech coding and decoding is much more difficult to achieve at the lower rate using CELP. One reason is that speech coded at lower bit rates has a higher noise level than speech coded at 16 kbps, making backward prediction considerably less accurate.

Thus, while prior art technology exists for providing high-quality speech coding and decoding based on backward prediction, none have taken advantage of backward prediction schemes to achieve these results at a low bit rate. Accordingly, there remains a need for a CELP method and device to code and decode speech signals at a low bit rate while maintaining high-quality performance.

SUMMARY OF THE INVENTION

The present invention improves the results of prior art codecs and meets the standards mentioned above by providing an improved speech codec that provides high-quality performance at a low bit rate by selective use of backward prediction.

Specifically, the present invention provides a more efficient coding method by deriving signal parameters through backward prediction, comprising the steps of: (1) classifying a segment of the digitized speech signal in one of a plurality of predetermined modes; (2) determining a set of unquantized line spectral frequencies to represent the vocal tract parameters for the segment; and (3) quantizing the determined set of unquantized line spectral frequencies in a mode-specific manner, using a combination of scalar quantization and vector quantization, wherein the quantization process varies depending on the mode in which the segment is classified. The invention also provides a method for decoding the encoded signal through an analogous process.

The encoding/decoding method and device of the present invention utilizes at least one vector quantization table having entries of vectors for quantizing a subset of the determined set of unquantized line spectral frequencies, in which a vector entry is accessed as a series of bits representing an index to the vector quantization table, and wherein the vector entries are arranged in the vector quantization table such that a change in the nth least significant bit of an index $i_1$ corresponding to a vector $v_1$ results in an index $i_2$ corresponding to a vector $v_2$ that is one of the $2^n$ vectors closest to the vector $v_1$, where closeness is measured by the norm distance metric between the vectors $v_1$ and $v_2$.

Furthermore, when the segment is determined to include voiced speech, the scalar quantization step further comprises the steps of: (1) predicting a quantized line spectral frequency for each unquantized line spectral frequency to be scalar quantized as a weighted sum of neighboring line spectral frequencies quantized in a previous digitized speech signal segment; and (2) encoding each of the unquantized line spectral frequencies as an offset from its corresponding predicted quantized line spectral frequency.

For segments containing voiced speech, the vector quantization step further comprises the steps of: (1) determining a range of indices for possible vectors in the vector quantization table for vector quantizing the subset of unquantized line spectral frequencies to be vector quantized, on the basis of the vector quantized line spectral frequencies of a previous digitized speech signal segment; (2) selecting a vector having an index within the determined range of indices for vector quantizing the subset of unquantized line spectral frequencies to be vector quantized; and (3) encoding the selected vector as an offset within the determined range of indices.

Also provided by the present invention is a method and device for encoding the excitation of a digitized speech signal, which selectively applies backward prediction in determining the fixed codebook gain in certain modes of speech that are free of transients. More specifically, the inventive method and device encodes the excitation of a digitized speech signal by (1) partitioning the digitized speech signal into discrete segments; (2) classifying a segment of the digitized speech signal in one of a plurality of predetermined modes, wherein the plurality of predetermined modes includes at least one non-transient mode for classifying a digitized speech signal segment not containing transients; (3) further partitioning the digitized speech signal segment into subframes for analyzing the excitation of the digitized speech signal segment, wherein the number of subframes depends on the mode in which the digitized speech signal segment is classified; and (4) modeling the excitation of each digitized speech signal subframe as a vector sum of an adaptive codebook vector scaled by an adaptive codebook gain, and a fixed codebook vector scaled by a fixed codebook gain, and wherein, for a digitized speech signal segment classified in any non-transient mode, the step of deriving the fixed codebook gain comprises backward predictive analysis.

As described in detail below, the encoding/decoding method and device of the present invention provide the important advantage over the prior art of efficiently providing high-quality speech coding and decoding taking advantage of the selective use of backward prediction to achieve these results at a low bit rate.

The invention itself, together with further objects and attendant advantages, will be understood by reference to the following detailed description, taken in conjunction with the accompanying drawings.

BRIEF DESCRIPTION OF THE DRAWINGS

FIG. 14 illustrates the bit allocation for encoding all the parameters in a Mode A frame.

FIG. 15 illustrates the bit allocation for encoding all the parameters in a Mode B frame.

FIG. 16 illustrates the bit allocation for encoding all the parameters in a Mode C frame of the present invention.

DETAILED DESCRIPTION OF THE DRAWINGS

Figure 1:
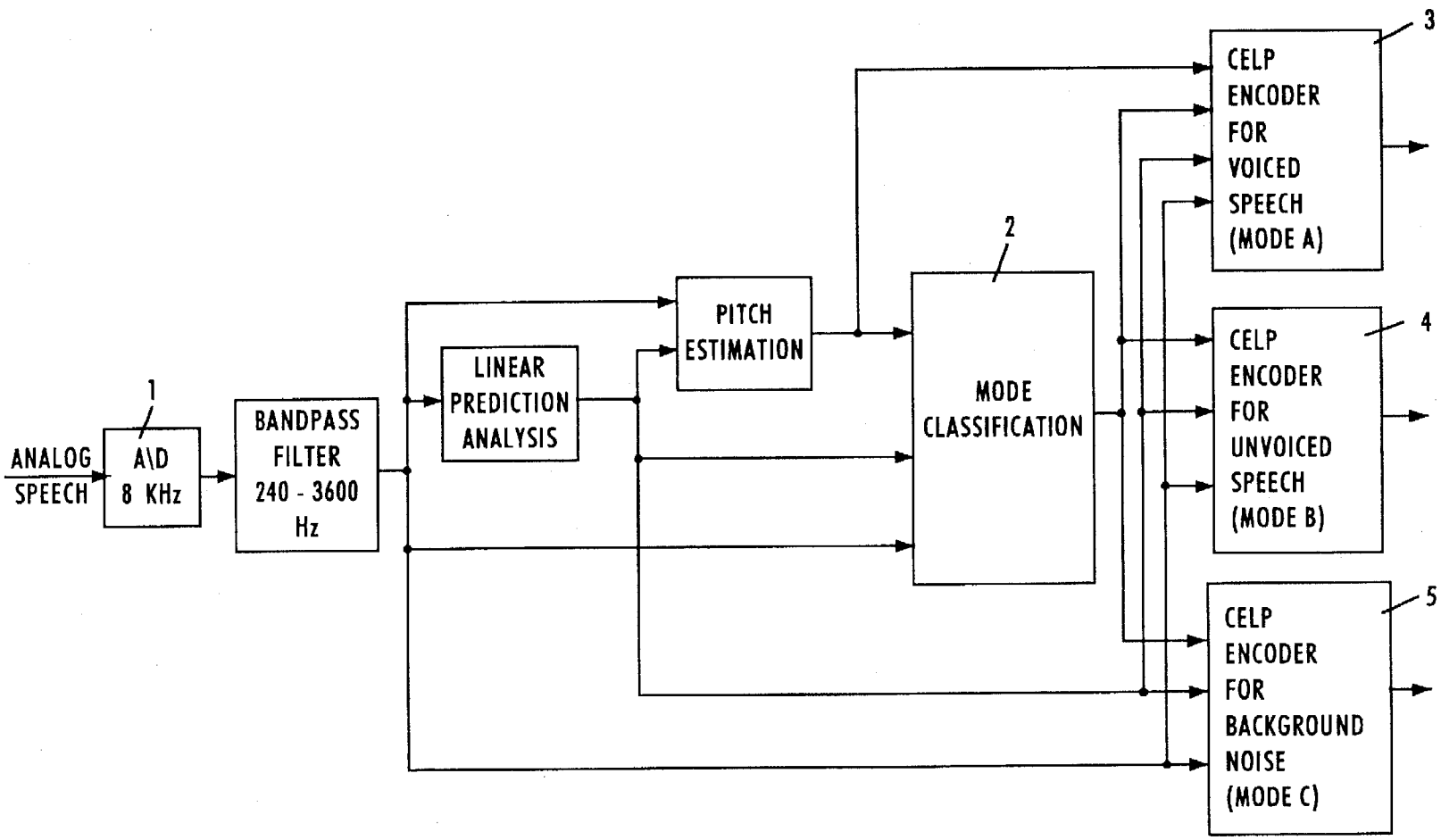
FIG. 1 is a block diagram of the operation of an embodiment of a low rate multi-mode CELP encoder as provided by the present invention.

The signal coding and decoding method and device taught by the present invention will be described in conjunction with drawings of generalized block diagrams and flow charts rather than specific embodiments in circuitry or computer code, in order to explain the invention in a more easily understood manner. While the drawings present a conceptualized breakdown of the present invention, the preferred embodiment of the present invention implements these steps through program statements rather than physical hardware components.

Specifically, the preferred embodiment comprises a digital signal processor TI 320C31, which executes a set of prestored instructions on a digitized speech signal, which has been sampled at 8 Khz and high-pass filtered. However, because one skilled in the art will recognize that the present invention may also be readily embodied in hardware, that the preferred embodiment takes the form of program statements should not be construed as limiting the scope of the present invention.

To understand the context in which the present invention applies, the general operation of a CELP system will be briefly summarized. Before being encoded, an input speech signal is digitized and filtered to attenuate dc, hum, or other low frequency contamination, and is buffered into frames to enable linear predictive analysis, which models the frequency shaping effects of the vocal tract.

The frames are further partitioned into subframes for purposes of excitation analysis, which utilizes the two codebooks described above to model the excitation of each subframe of the input speech signal. A vocal tract filter generates speech by filtering a sum of vectors, scaled by gain parameters, selected from the two codebooks. The vectors ultimately used to model the excitation are selected by comparing the differences between the input signal and the speech signal synthesized from the vector sum, taking into account the noise masking properties of the human ear. Specifically, the differences at frequencies at which the error is less important to the human auditory perception are attenuated, while differences at frequencies at which the error is more important are amplified. After testing all possible codebook vectors, the vectors producing the minimal perceptually weighted error energy are selected to model the input speech. A bitstream of data encoding the selected vectors—i.e., their codebook indices and their codebook gains—is multiplexed with the short-term predictor or vocal tract filter parameters, and transmitted to the decoder.

The decoder receives the bitstream from the encoder and reconstructs the excitation vectors represented by the codebook indices, multiplies the vectors by the appropriate gain parameters, and computes the vector sum representing the excitation of the signal, which is then passed through a vocal tract filter to synthesize the speech.

At low bit rates, a relatively small number of bits are available to encode the input speech signal. As a result, conventional CELP codecs either have very few bits to encode the parameters or update the parameters very slowly. In either case, the net effect is a loss of voice quality in the reconstructed speech.

In contrast to conventional CELP codecs, a multi-mode CELP codec is able to achieve high quality performance at low bit rates by labelling every input speech frame as being in one of a plurality of modes and using CELP in a mode-specific fashion. The paper of K. Swaminathan et al., "Speech and Channel Codec Candidate for the Half Rate Digital Cellular Channel," presented at the 1994 ICASSP Conference in Adelaide, Australia, describes one such multi-mode CELP codec.

Figure 2:
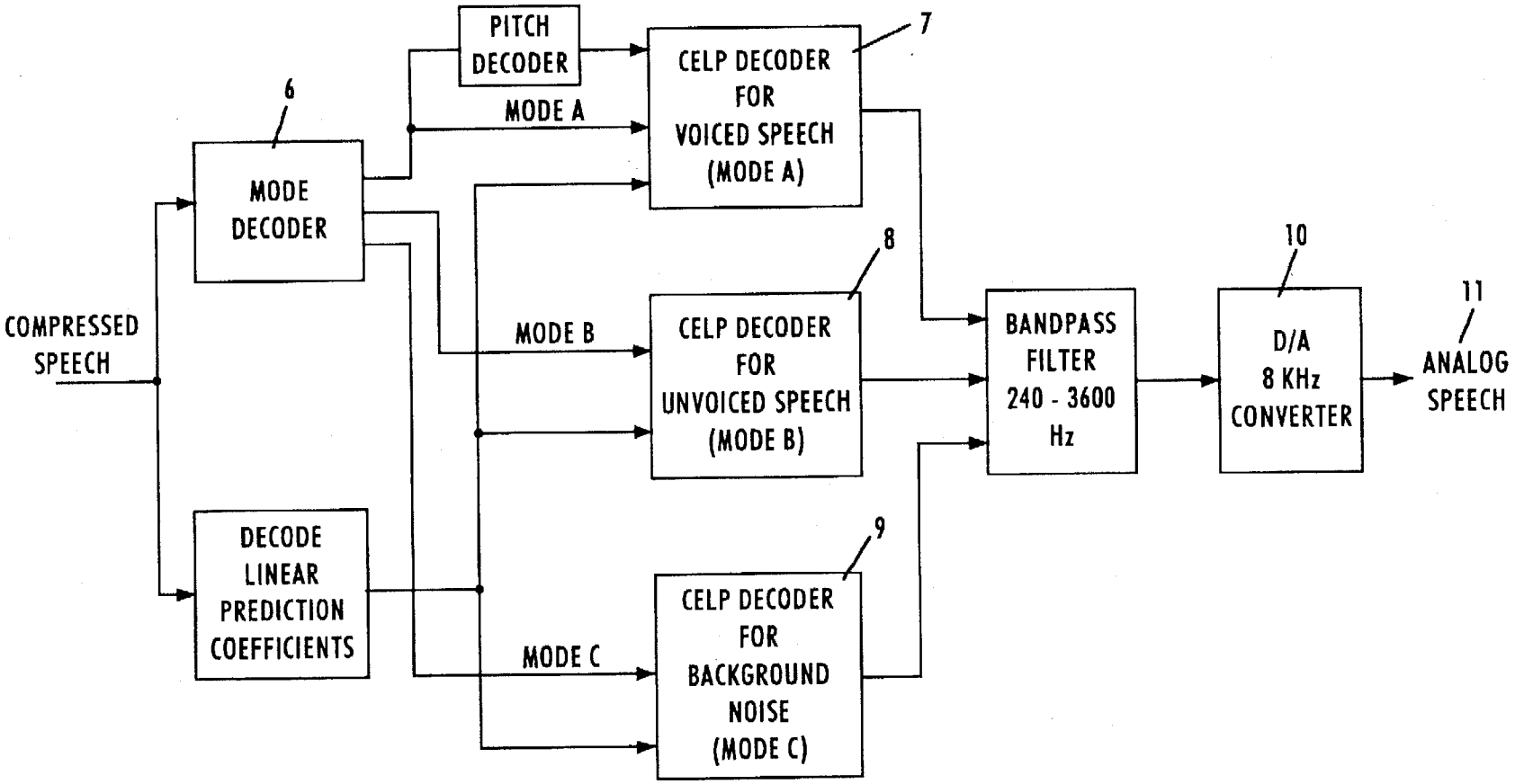
FIG. 2 is a block diagram of the operation of an embodiment of a low rate multi-mode CELP decoder as provided by the present invention.

FIGS. 1 and 2 respectively illustrate possible embodiments of a multi-mode CELP encoder and decoder, as provided by the present invention. As with conventional CELP systems, an analog speech signal is sampled by an A/D Converter 1 and high-pass filtered to attenuate any dc, hum, or other low frequency contamination before the encoder shown in FIG. 1 performs linear predictive analysis. Unlike conventional CELP systems, at this point, the Mode Classification module 2 of the multi-mode CELP encoder provided by the present invention classifies the input signal into one of three modes: 1) voiced speech ("Mode A"); 2) unvoiced speech ("Mode B"); or 3) non-speech background noise ("Mode C"). By defining the modes according to the different characteristics of different types of signals, this classification enables the present invention to provide an enhanced quality of performance in spite of the low bit rate. Once the mode of an input signal frame has been determined, the codec provided by the present invention performs speech analysis in a mode-specific manner 3, 4, 5 and outputs the parameters for that frame as compressed speech.

The exemplary decoder illustrated in FIG. 2 operates in a fashion analogous to that of the encoder of FIG. 1. As shown, the Mode Decoder 6 determines the mode of the speech signal from the received bitstream of compressed speech before the decoder reconstructs the signal, in order to benefit from the improvements achieved by the mode-specific coding techniques of the present invention. The signal is then decoded in a manner depending on its mode 7, 8, 9, and is filtered and passed through a D/A Converter 10 to reconstruct the analog speech signal 11.

The present invention concentrates on improving the steps of encoding and decoding the short-term predictor parameters and the fixed codebook gain of a speech signal in a multi-mode CELP codec. In order to achieve these improvements, the present invention selectively utilizes backward prediction for both of these parameters to achieve better performance at lower bit rates.

In the preferred embodiment, the line spectral frequencies (LSFs) and fixed codebook gain are distinct parameters: the LSFs are a specific representation of parameters for the short-term predictor modeling the frequency shaping effects of the vocal tract, while the fixed codebook gain is a measure of the residual excitation level. Consequently, the values of one are not dependent on the values of the other, and the improved coding method and format for these parameters provided by the present invention will be discussed separately below.

Figure 3:
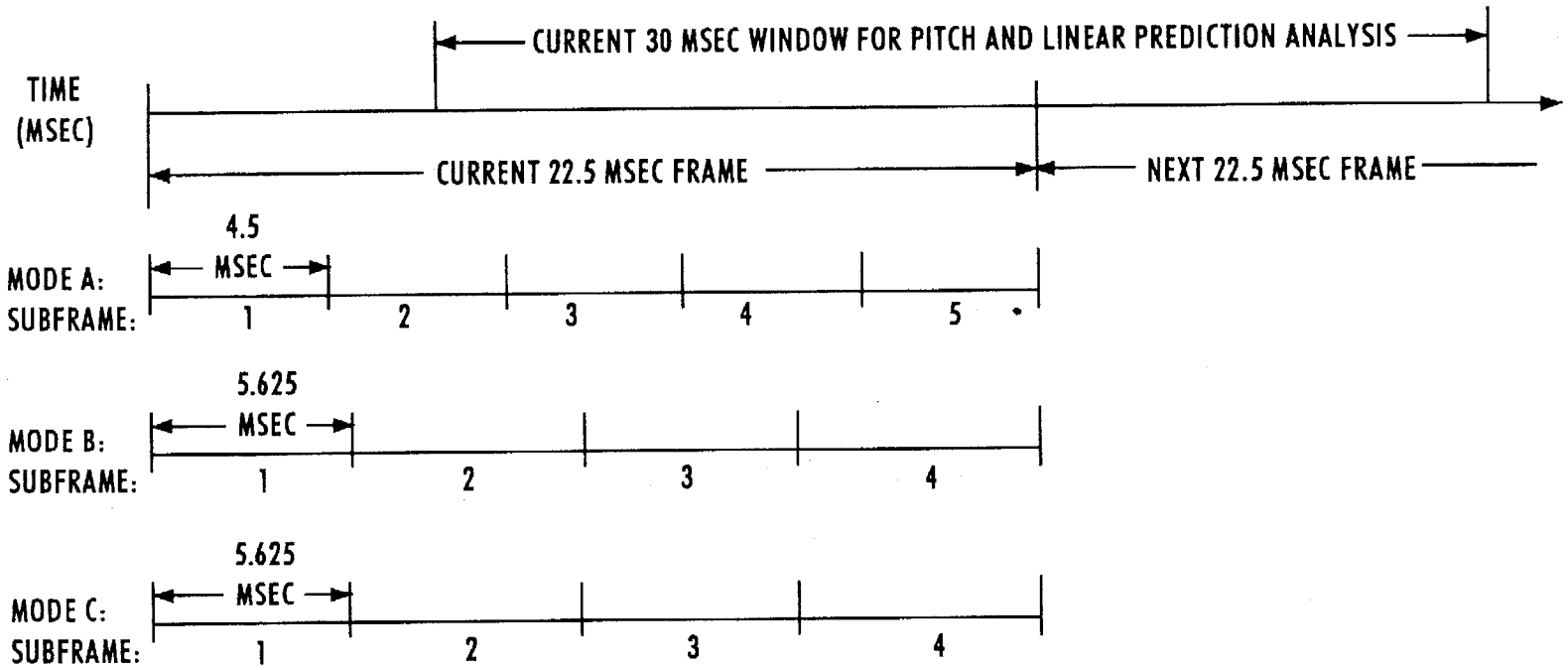
FIG. 3 is a timing diagram of a preferred embodiment.

Some background information is helpful to explain the context in which the present invention applies. In the preferred embodiment of the present invention, the encoding process begins by performing linear predictive analysis on a signal frame of 22.5 msec, which is further partitioned into a number of subframes depending on the mode of the signal frame, and is analyzed on the basis of a 30 msec speech window centered at the end of each frame. FIG. 3 is a timing diagram that illustrates the relationship between the frame, subframes, and the linear predictive analysis window (which is also used for open loop pitch analysis) in all three modes.

Various methods of linear predictive analysis are taught in the prior art, including autocorrelation and covariance, as well as the lattice method, which is a kind of combination of covariance and autocorrelation. The preferred embodiment uses the lattice method, which has the benefits of enabling direct determination of the filter coefficients from the speech samples without intermediate calculation of autocorrelation functions, and guaranteeing a stable filter without requiring use of a window.

Specifically, the preferred embodiment utilizes the Burg lattice method, which is known in the art and further described in J. Makhoul, "Stable and Efficient Lattice Methods for Linear Prediction," IEEE Transactions on ASSP, Vol. ASSP-25, No. 5, October 1977.

The linear predictive analysis derives reflection and filter coefficients, the latter of which are bandwidth broadened by 30 Hz in the preferred embodiment to avoid sharp spectral peaks. These bandwidth broadened filter coefficients are then converted to line spectral frequencies through a process described by F. K. Soong and B. H. Juang in their article "Line Spectrum Pair (LSP) and Speech Data Compression," which was presented at a 1984 ICASSP Conference. LSFs are particularly well suited for quantization because of their well-behaved dynamic range and ability to preserve filter stability after quantization.

Once the LSFs are found, they are arranged in increasing order to form the set of line spectral frequencies for that frame. In the preferred embodiment, ten LSFs are determined for each signal frame.

Because the present invention employs mode-specific coding techniques, it is necessary to determine the mode of a particular signal frame. As mentioned above, the preferred embodiment classifies speech signals into the three modes: 1) Mode A, indicating voiced speech; 2) Mode B, indicating unvoiced or transient speech; and 3) Mode C, indicating background noise.

Those skilled in the art will recognize that there are a variety of methods to determine whether a particular signal frame contains voiced speech, unvoiced or transient speech, or non-speech background noise. In the preferred embodiment, mode classification is based on analysis of the following factors of the signal frame: 1) spectral stationarity (indicative of voiced speech); 2) pitch stationarity (indicative of voiced speech); 3) zero crossing rate (indicative of a high frequency content); 4) short term level gradient (indicative of the presence of transients); and 5) short term energy (indicative of the presence of speech rather than non-speech background noise).

More specifically, Mode A is indicated by an indication of spectral stationarity, pitch stationarity, low zero crossing rate, lack of transients, and an indication of the presence of speech throughout the frame. Mode C is suggested by an absence of pitch, high zero crossing rate, the absence of transients, or a low short term energy relative to the estimated background noise energy. Mode B is indicated by a lack of strong indication of Mode A or Mode C. In the preferred embodiment, the determined mode of the signal frame is indicated by setting allocated bits.

To understand the improvements achieved by the present invention, the coding format for the LSFs that is used for non-stationary speech and for background noise (Mode B and Mode C) will first be explained. In the preferred embodiment, a combination of scalar and vector quantization is used to code and decode the ten LSFs used to represent each signal frame—scalar quantization for the first six LSFs, and vector quantization for the last four. However, the six/four breakdown is merely exemplary, as various combinations of scalar and vector quantization can be used.

The codec of the preferred embodiment achieves high quality performance by using two distinct sets of scalar quantizers on the first six LSFs: one trained on IRS-filtered speech and the other trained on unfiltered flat speech. "IRS" refers to the intermediate reference system filter specified by the International Telegraph and Telephone Consultative Committee ("CCITT"), an international communications standards organization, in its Recommendation P.48 (adopted originally at Geneva, 1976, and amended thereafter at Geneva, 1980, Malaga-Torremolinos, 1984, and Melbourne, 1988), and reflects the frequency shaping effects of carbon microphones used in some telephone handsets. Unfiltered flat speech or, equivalently, unfiltered speech, refers to speech recorded by a high quality microphone having a relatively flat frequency response. Both sets include a variety of speakers, recording conditions and dialects in order to provide consistent high quality performance on signals from different speakers and in different environments.

Figure 4:
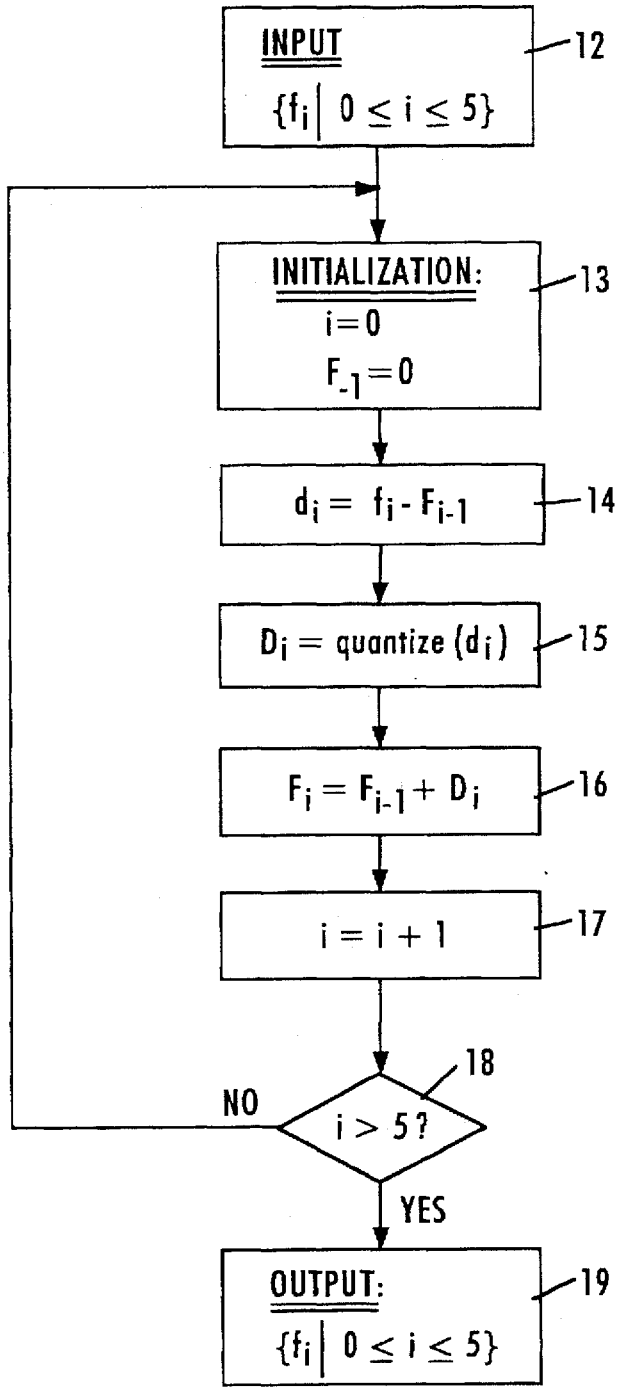
FIG. 4 is a flow chart illustrating the scalar quantization process for signals classified in Mode B or Mode C, as provided by the present invention.

The scalar quantization process is the same with both the IRS-filtered set and the flat set. The flow chart of FIG. 4 explains the steps of the scalar quantization of the first six LSFs in the preferred embodiment:

1. Initialize (13):
   $i=0$ where i represents the index into the set $\{f_i\}$ (12), comprising the first six unquantized LSFs;
   $F_{-1}=0.0$ where $\{F_i\}$ is the set of quantized LSFs to be determined.
2. Compute (14):
   $d_i=f_i-F_{i-1}$ where $d_i$ represents the difference between the ith unquantized LSF and the (i−1)th quantized LSF.
3. Quantize $d_i$ (15) using the ith scalar quantizer to $D_i$, where $D_i$ is the quantized difference.
4. Set the ith quantized LSF (16):
   $F_i=F_{i-1}+D_i$
5. Increment (17):
   $i=i+1$
6. Repeat from step 2 until i equals the number of LSFs represented by scalar quantizers, which in the preferred embodiment is six (18).

Unlike the first six LSFs, the last four LSFs are quantized by a single index into a vector quantization table ("VQ Table"). This selective application of vector quantization permits the present invention to maintain high quality representation of the short term predictor by retaining individual scalar quantization of some LSFs, while enhancing the efficiency by vector quantizing the remaining four LSFs as a group. As with the scalar quantizers, separate VQ Tables are provided for IRS-filtered speech and for unfiltered flat speech.

Each VQ Table of the preferred embodiment has 512 ($2^9$) entries of 4-dimensional vectors, thus requiring the index to be comprised of 9 bits. In order to enable a more efficient table search, as well as a more efficient method of referencing table entries, in the preferred embodiment, the vectors are arranged in the VQ Table such that a change in the nth least significant bit of a 9-bit VQ index $i_1$ corresponding to a vector $v_1$ results in an index $i_2$ corresponding to a vector $v_2$ that is one of the $2^n$ vectors closest to the vector $v_1$, where "closeness" is measured by the $L_2$ norm distance metric between the two vectors. For example, a change in the least significant bit results in one of the two closest vectors, a change in the second least significant bit results in one of the four closest vectors, a change in the third least significant bit results in one of the eight closest vectors, and so on.

Figure 5:
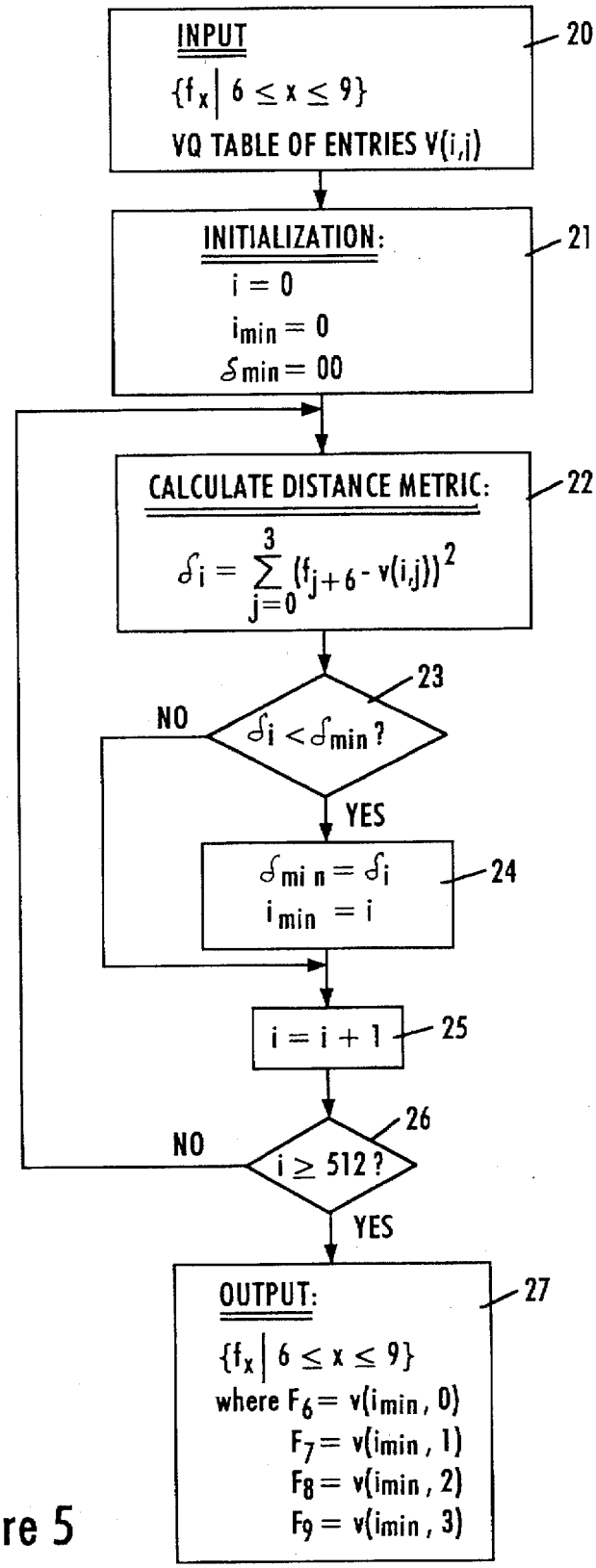
FIG. 5 is a flow chart illustrating the vector quantization process for signals classified in Mode B or Mode C, as provided by the present invention.

FIG. 5 illustrates the process of vector quantization as provided in the preferred embodiment of the present invention. The process is the same for the IRS-filtered VQ Table and the flat unfiltered VQ Table. As indicated by the inputs 20 and outputs 27, vector quantization attempts to quantize unquantized LSFs $\{f_x\}$ of the input signal with a vector v (i, j) from the VQ Table having the minimum distance metric $\delta_{min}$, where i is the VQ Table index and j is the dimension of the vector.

As previously indicated, the VQ Table of the preferred embodiment of the present invention has 512 entries. Thus, i ranges from 0 to 511 and is initialized at 0 (21). $i_{min}$ is the VQ Table index whose corresponding vector $v(i_{min}, j)$ has the minimum distance metric of the vectors already tested, and $\delta_{min}$ is the minimum distance metric of the table entries previously calculated. Thus, $i_{min}$ is initialized at 0 and $\delta_{min}$ is initialized at "∞," which may be any number higher than the possible range of distance metrics 21.

As shown, the distance metric $\delta_i$ is calculated for entry i of the VQ table, and is saved as $\delta_{min}$ if it is the minimum distance metric value thus far calculated 24. Once all of the entries have been tested, the four LSFs are quantized by the VQ Table vector $v(i_{min}, j)$, with each having a parameter j indicating the appropriate vector dimension 27.

Figure 6:
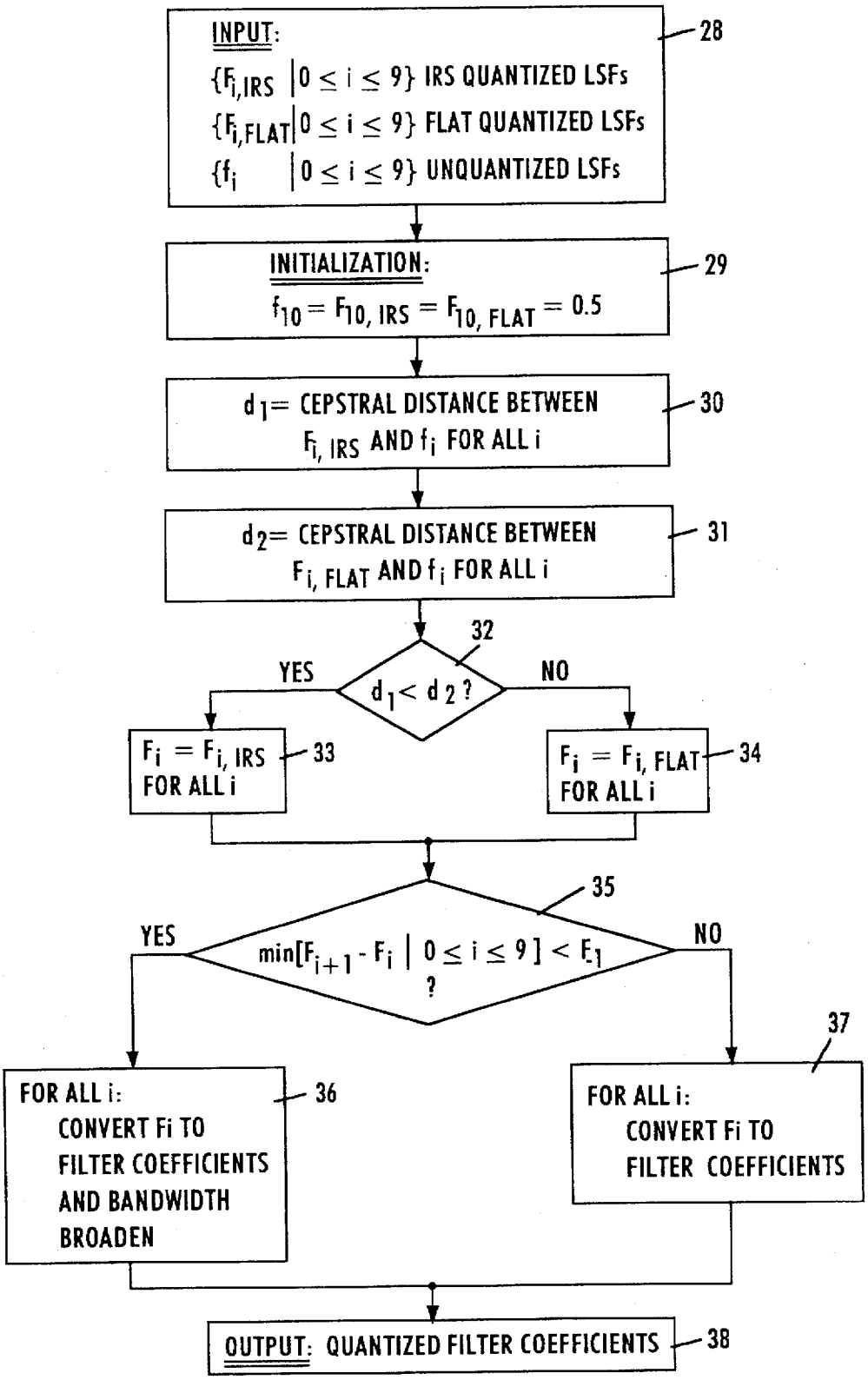
FIG. 6 is a flow chart illustrating the process of selecting either the IRS-filtered quantizers or the flat unfiltered quantizers for signals classified in Mode B or Mode C, as provided by the present invention.

After the IRS-filtered and the unfiltered flat sets of scalar and vector quantifiers are determined, the multi-mode CELP codec provided by the present invention must determine which of the two sets will more accurately represent the LSFs. This selection process in the preferred embodiment, as shown in FIG. 6, selects the set having the lower cepstral distortion measure between the filter coefficients of the quantized LSFs $\{F_{i,IRS}|0\leqq i\leqq 9\}$, $\{F_{i,flat}|0\leqq i\leqq 9\}$ and the corresponding unquantized filter coefficients $\{f_i|0\leqq i\leqq 9\}$. The set selected to represent the LSFs is then converted to a set of 4-bit indices for the first six LSFs, and a 9-bit VQ index for the last four LSFs. One bit is used to indicate whether the selected set is the IRS-filtered set or the flat set, making a total of 34 bits used for encoding the ten LSFs of a Mode B or a Mode C signal frame. Bit allocation for a Mode B or a Mode C signal frame for the short term predictor parameters is illustratively shown in FIGS. 15 and 16 respectively.

Finally, the quantized set of LSFs is examined to see if adjacent quantized LSFs are closer than a predetermined minimum acceptable threshold $F_T$ 35, as excessively close proximity results in a tonal distortion in the synthesized speech. If the adjacent quantized LSFs are closer than $F_T$, the filter coefficients corresponding to the quantized LSFs are bandwidth broadened to mitigate or eliminate this distortion 36.

Quantization of Mode B and Mode C signals can be made more efficient by eliminating the step of testing over the VQ Table trained on IRS-filtered speech. It has been our experience that the voice quality of the reconstructed speech is not greatly affected if only the VQ Table corresponding to the unfiltered flat set of vectors is used. This eliminates the need to store the second VQ Table of 2048 (512 4-dimensional) entries corresponding to the IRS-filtered set, and simplifies the vector quantization process by requiring a search of only one VQ Table. For this reason, the vector quantization performed by the preferred embodiment uses only a VQ Table trained on unfiltered flat speech.

Unlike Mode B and Mode C signals, voiced speech (Mode A) is characterized by spectral stationarity which indicates a degree of regularity in the spectral parameters, enabling the use of backward prediction. The present invention takes advantage of this property to reduce the number of bits required to encode the quantized LSFs, enabling encoding of Mode A signals at low bit rates with a high degree of fidelity. The backward predictive differential quantization scheme by which the present invention reduces the number of bits required to represent the quantized LSFs will now be explained with reference to FIGS. 7–10.

Figure 7:
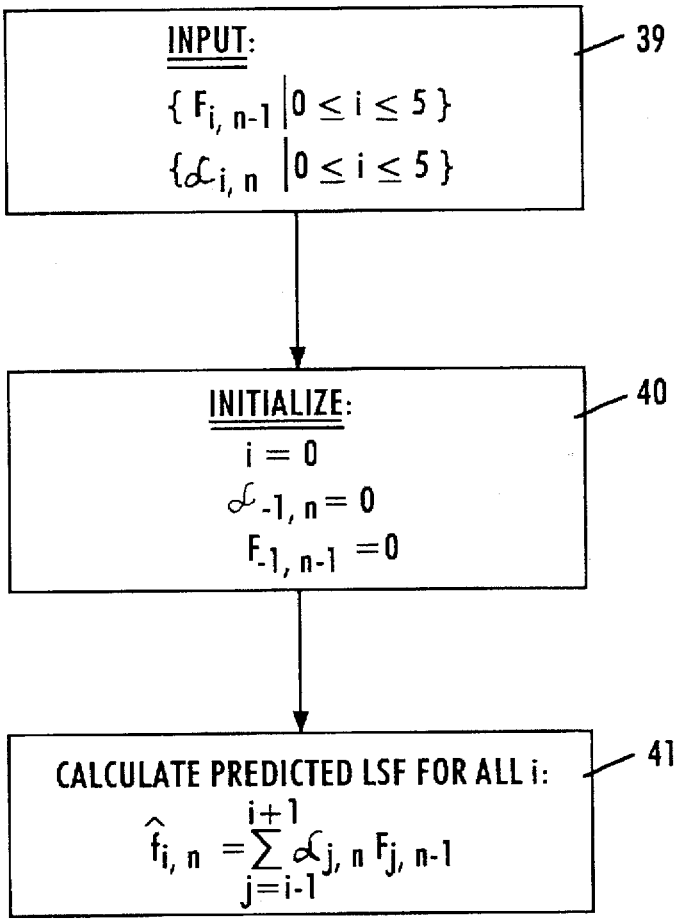
FIG. 7 illustrates the process of backward prediction for the LSFs in a Mode A frame, as provided by the present invention.
Figure 8:
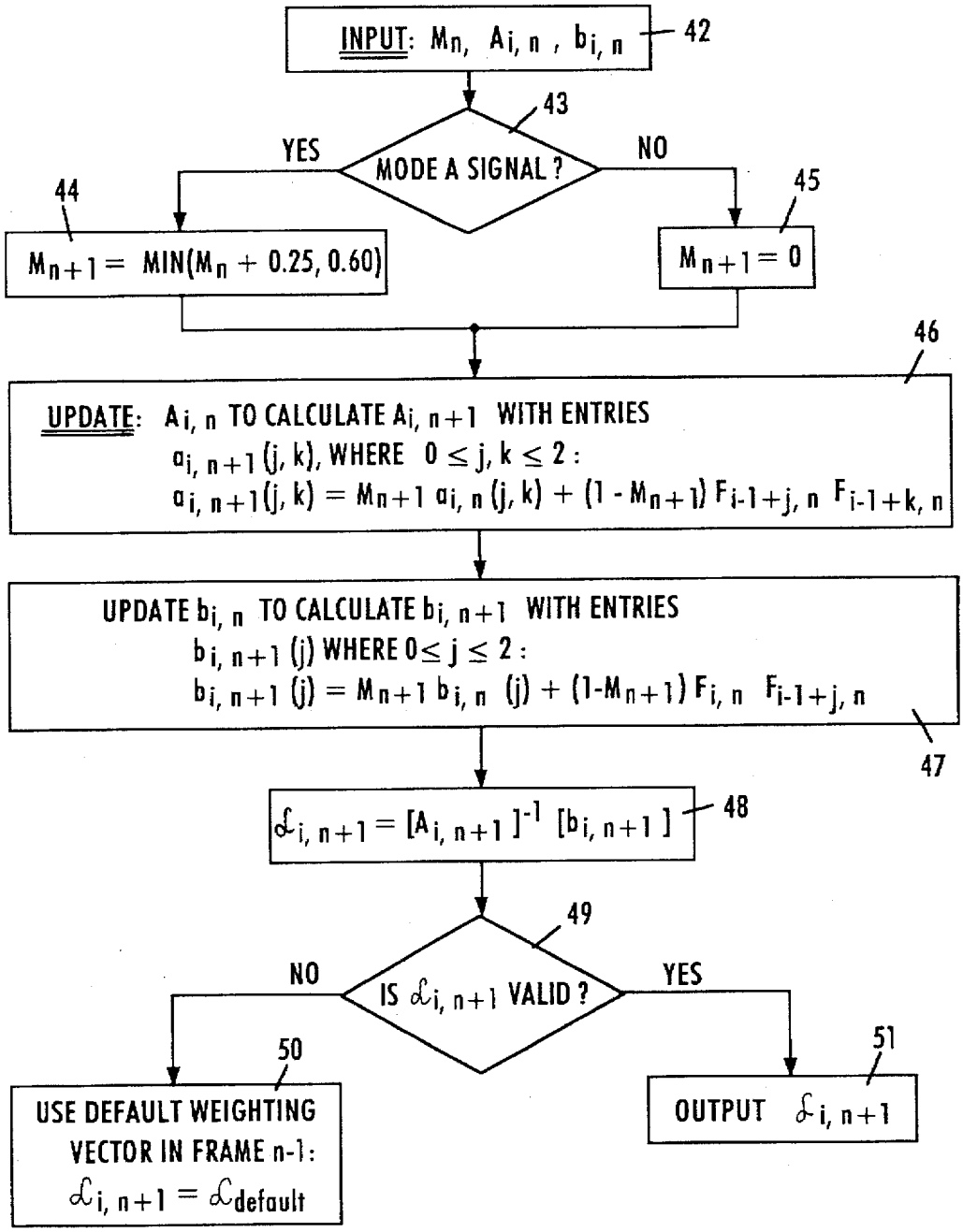
FIG. 8 illustrates the process of updating the weighting factors used in the backward prediction for the LSFs in a Mode A frame, as provided by the present invention.
Figure 9:
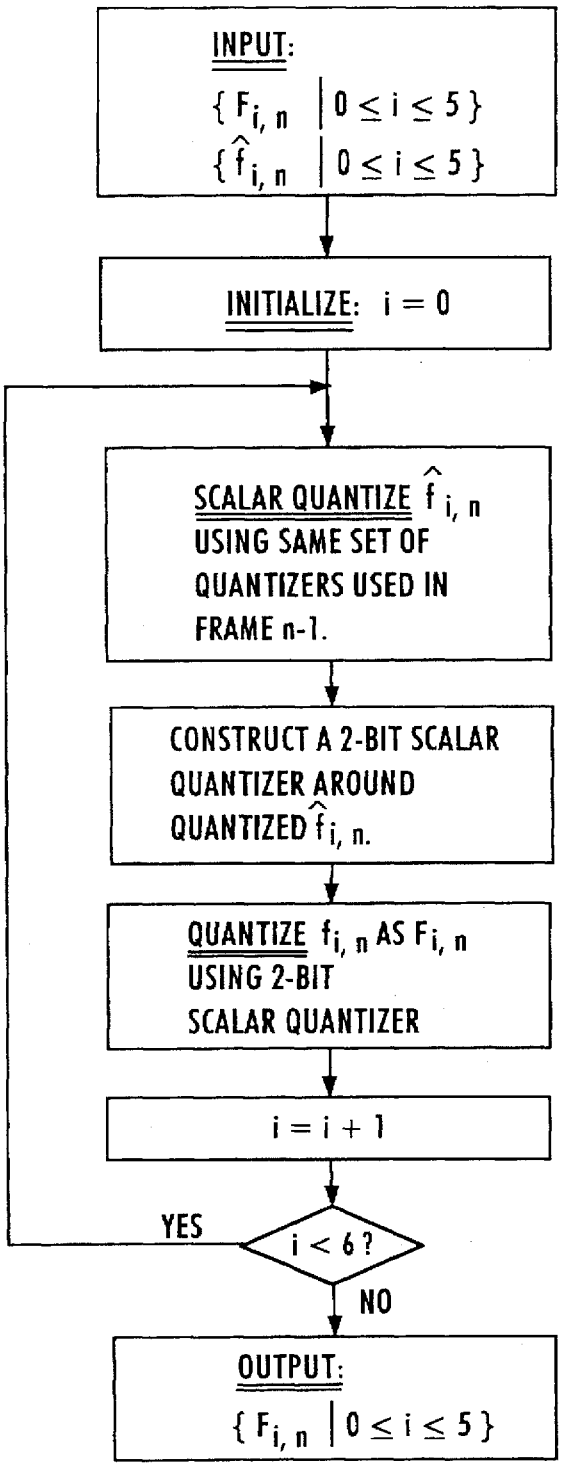
FIG. 9 illustrates the differential scalar quantization of the previously scalar quantized LSFs in a Mode A frame, as provided by the present invention.

The flow charts shown in FIGS. 7, 8 and 9 illustrate the process of backward prediction of the scalar quantized LSFs in a Mode A frame, as provided in a preferred embodiment of the present invention. Rather than using four bits to encode each of the first six scalar quantized LSFs, the codec of the preferred embodiment first estimates each of the first six LSFs of a particular frame n as a weighted sum of the neighboring scalar quantized LSFs of the previous frame n−1, as shown in FIG. 7. The estimated LSFs for frame n are quantized using the same set of quantizers (either the IRS-filtered or the unfiltered flat set) that was used to encode the previous frame n−1. Each estimated quantized value for an LSF of frame n is then compared with its corresponding, unquantized LSF for the same frame, and encoded as a 2-bit offset from the estimate, a process shown in FIG. 9.

More specifically, as shown in FIG. 7, the ith LSF in the nth frame, $f_{i,n}$, is estimated by the formula (41):

$$\hat{f}_{i,n}=\alpha_{i-1,n}F_{i-1,n-1}+\alpha_{i,n}F_{i,n-1}+\alpha_{i+1,n}F_{i+1,n-1}$$

where $0 \leqq i < M$ (M represents the number of scalar quantized LSFs), and a boundary condition is $F_{-1,n-1}=0$ (40). As previously noted, the preferred embodiment scalar quantizes six LSFs, so M=6.

In matrix notation:

$$\hat{f}_{i,n}=\alpha_{i,n}^{T}F_{i,n-1}$$

where:

$\alpha_{i,n}=[\alpha_{i-1,n}, \alpha_{i,n}, \alpha_{i+1,n}]^T$ represents the weighting vector of the ith LSF in the nth frame; and $F_{i,n-1}=[F_{i-1,n-1}, F_{i,n-1}, F_{i+1,n-1}]^T$ represents the quantized LSF vector for the previous frame.

At the end of frame n, $\alpha_{i,n+1}$ must be determined for use in frame n+1. The weighting vector $\alpha_{i,n}$ is updated by minimizing the distortion $\epsilon_{i,n}$ as measured by the mean squared error between the predicted and actual quantized LSFs for frame n:

$$\epsilon_{i,n}=E[(F_{i,n}-f_{i,n})^2]$$

where E[] is an averaging operator defined as:

$$E[x]=\mu_n E[x]+(1-\mu_n)x$$

Here, $\mu_n$ is a "forgetting factor" updated to determine $\mu_{n+1}$ at the end of frame n, and is used for determining the weight to attach to the previous estimate of x. As shown in FIG. 8, which illustrates the process of updating the weighting factors used in the backward prediction for the LSFs in a Mode A frame, in signals other than voiced speech (specifically, signals classified in Mode B or C), there is spectral nonstationarity, and therefore, past estimates of x are irrelevant to predicting the current value. Accordingly, forgetting factor $\mu_{n+1}$ is set to 0 (45).

However, the spectral stationarity of voiced speech signals (Mode A) enables prediction based on prior frames, and thus, as shown in FIG. 8, at the end of frame n, the value for $\mu_{n+1}$ is determined by (44):

$$\mu_{n+1}=\min(\mu_n+0.25, 0.60)$$

Thus, as we enter into a voiced and stationary portion of speech, we increase our reliance on past values of x up to a certain point. This increase was determined empirically, and in the preferred embodiment, takes place at a rate of 0.25 per frame, up to a maximum of 0.60.

The backward prediction updates of the weighting factors are also summarized in FIG. 8. As discussed, weighting vectors α for frame n+1 can then be determined by minimizing $\epsilon_{i,n}$, a standard calculus problem whose solution can be expressed as (48):

$$\alpha_{i,n+1}=A_{i,n}^{-1}b_{i,n}$$

where $A_{i,n}$ is a 3×3 matrix whose entries $a_{i,n}(j, k)$ are updated at the end of a frame n by (46):

$$a_{i,n+1}(j,k)=\mu_{n+1}a_{i,n}(j,k)+(1-\mu_{n+1})\,F_{i-1+j,n}F_{i-1+k,n}$$

where $0 \leqq j,k \leqq 2$; and vector $b_{i,n}$ is a 3-dimensional vector whose entries $b_{i,n}(j)$ are updated by (47):

$$b_{i,n+1}(j)=\mu_{n+1}b_{i,n}(j)+(1-\mu_{n+1})\,F_{i,n}F_{i-1+j,n}$$

where $0 \leqq j \leqq 2$.

To contribute to an accurate prediction, the determined weighting factors must be in the range from 0 to 1 (49). Accordingly, a negative value for any α indicates that the weighting will not be accurate, and in this situation, weighting will not be used at all. Hence, the default weighting vector used to estimate the scalar quantized LSFs in frame n+1 is:

$$\alpha_{default}=[0.0\ 1.0.0]^T$$

In other words, the ith LSF estimate for frame n+1 would simply default to the ith quantized LSF value for the previous frame n.

The updated weighting vector $\alpha_{i,n+1}$ for frame n+1 is then used to predict the LSFs for frame n+1:

$$\hat{f}_{i,n+1}=\alpha_{i,n+1}^{T}F_{i,n}$$

As noted above, these updates are carried out in every frame, but are used for encoding LSFs only for voiced signals (Mode A). For signals determined to be Mode B or Mode C, because they have no spectral stationarity, backward prediction is not used for encoding the LSFs.

The differential quantization process in the preferred embodiment for the first six LSFs for a Mode A signal is illustrated in FIG. 9. The backward predicted LSFs $\{\hat{f}_{i,n} | 0 \leqq i \leqq 5\}$ determined by the process illustratively shown in FIGS. 7 and 8, are now quantized using the same set of quantizers used in frame n−1.

Figure 10:
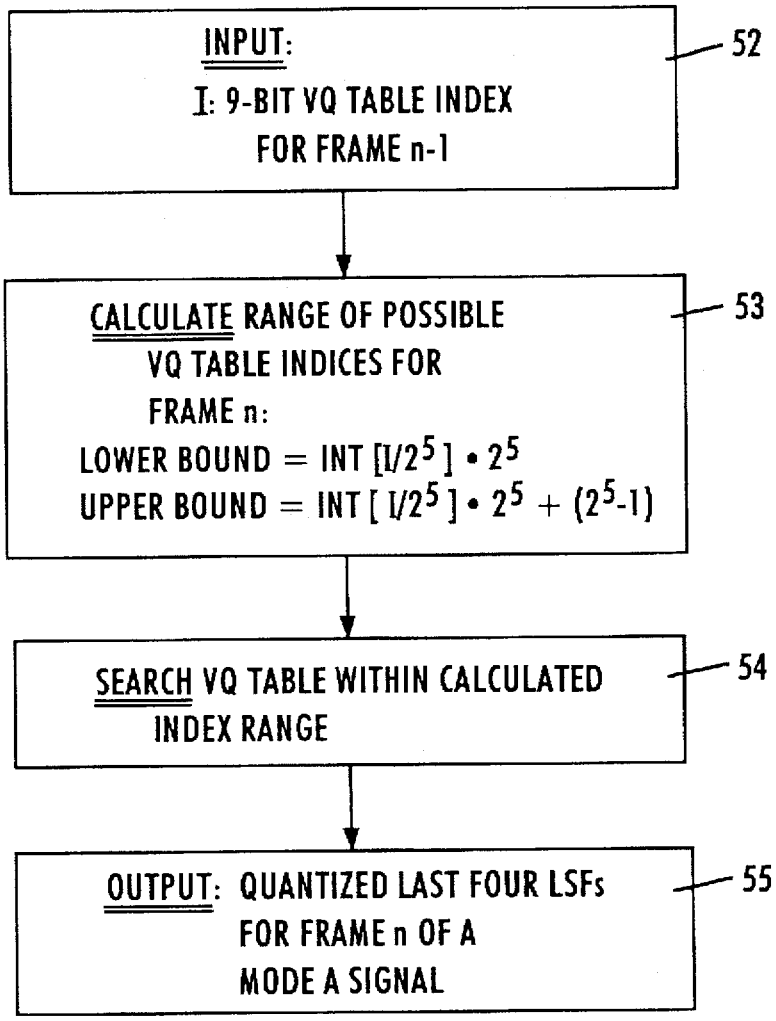
FIG. 10 illustrates the differential vector quantization of the previously vector quantized LSFs in a Mode A frame, as provided by the present invention.

The above discussion illustrates how differential quantization is used for the scalar quantized LSFs in a Mode A signal frame. FIG. 10 illustrates differential quantization used for the vector quantized LSFs in a Mode A signal frame. As explained above, the VQ Table entries are specially arranged such that a change in the nth least significant bit of a VQ Table index $i_1$ corresponding to a vector $v_1$ results in an index $i_2$ of a vector $v_2$ that is one of the $2^n$ closest vectors to the vector $v_i$.

Because of the spectral stationarity of Mode A signals, the vector of a frame is unlikely to be significantly different from that of the prior frame. Thus, in the present invention, it is represented as an offset from the index of the vector used in the preceding frame. Specifically, in the preferred embodiment, if the VQ index of the last frame is I (52), and B bits are allocated for the current frame's VQ index offset, the $2^B$ vectors closest to the vector of the prior frame have possible indices ranges from: $[I/2^B]\cdot 2^B$ through $([I/2^B]\cdot 2^B)+(2^B-1)$, where [x] is the integer obtained by truncating x (53).

In the preferred embodiment of the present invention, B=5, so the vector quantization of the last 4 LSFs of a frame n is represented as one of the 32 vectors closest to the vector quantization of the last 4 LSFs of the previous frame.

Once the range has been determined, the process used for vector quantization of the last four LSFs is the same as that shown in FIG. 5, except that only the VQ table entries having indices in the determined range need be tested. One way of doing this is to let i range from 0 to 31 and represent the index by x+i, where x is set to the lower bound of the determined range ($[I/2^B]\cdot 2^B$).

As mentioned above, the codec of the present invention provides a more efficient format and method to encode and decode the short-term predictors of speech signals for filter coefficients as well as fixed codebook gain. The advantages with respect to filter coefficients have been described above.

To understand the advantages achieved with respect to fixed codebook gain afforded by the present invention, the overall coding method used by the multi-mode codec of the present invention must be explained in greater detail.

As previously explained, because the present invention achieves advantages by mode-specific coding techniques, it must determine whether a signal frame is classified as Mode A (voiced stationary speech), Mode B (unvoiced or transient speech) or Mode C (background noise). To aid in this classification, open loop pitch estimation is used and one skilled in the art will recognize that there are a variety of pitch estimation methods. Those skilled in the art will also recognize that there are a variety of methods by which to classify a particular signal frame. As discussed briefly above, mode classification in the preferred embodiment is based on analysis of the characteristics of a signal frame. More specifically, the multi-mode codec provided by the present invention analyzes the current and the immediately preceding frames to determine spectral stationarity (indicative of voiced speech) and pitch stationarity (indicative of voiced speech). It further analyzes the current frame to determine the zero crossing rate (indicative of a high frequency content), short term level gradient (indicative of the presence of transients), and short term energy (indicative of the presence of speech throughout the frame).

Figure 11:
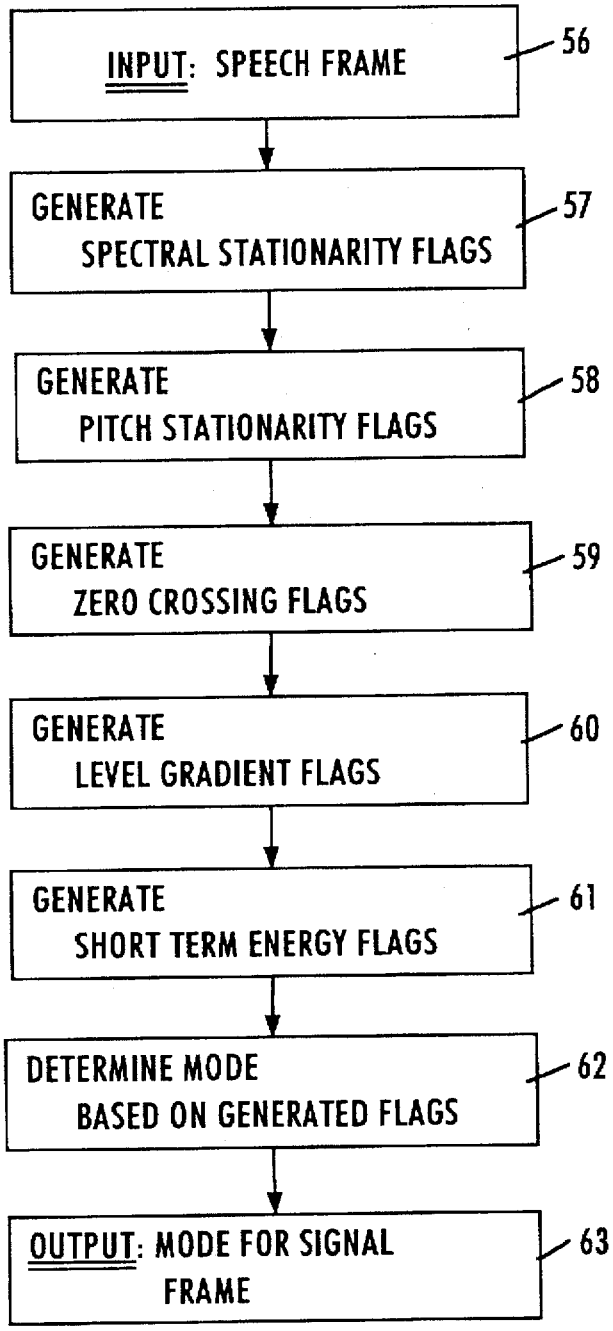
FIG. 11 illustrates the mode selection process as provided by the present invention.

As FIG. 11 indicates, the preferred embodiment generates bit flags indicative of a particular feature. Specifically:

1) two flags are provided to indicate degrees of spectral stationarity, which is detected by comparing the cepstral distortion between the differentially quantized and unquantized filter coefficients, by measuring the deviation of each differentially quantized LSF, and by measuring the residual energy after linear predictive analysis (57);
2) two flags are provided to indicate degrees of pitch stationarity, which is measured by open loop pitch analysis of the current and previous frames (58);
3) two flags are provided to indicate the number of subframes within a signal frame having a high zero crossing rate and a low zero crossing rate (59);
4) two flags are provided to indicate the level gradient, which shows the likelihood of the presence of transients within the signal frame and is measured by comparing the low-pass filtered version of the companded input signal amplitude of a subframe with that of previous subframes (60); and
5) five flags are provided to indicate the short term energy to determine the presence of speech during the subframes of the signal frame (61).

Having expressed all the attributes of the input frame in the form of one or more flags, the preferred embodiment analyzes the flags and sets allocated bits for the frame to indicate the determined mode (62). The mode determination procedure first classifies the input as background noise or speech. Background noise (Mode C) is declared either on the basis of the strongest short term energy flag alone or by combining weaker short term energy flags with the flags indicating high zero crossing rate, absence of pitch, or absence of transients. If speech is indicated, further classification as voiced and stationary (Mode A) is made by combining the spectral stationarity flags, pitch stationarity flags, flags indicating absence of transients, short term energy flags indicating presence of speech throughout the frame, and low zero crossing rate flags. Mode B is indicated if neither Mode C nor Mode A is declared. The mode determination algorithm prohibits any mode change from Mode C to Mode A or from Mode A to Mode C—either of these changes must take place via the default Mode B.

If a signal frame is classified as voiced stationary speech (Mode A), the excitation of the frame is analyzed in five equal subframes, each having a duration of 4.5 msec, as shown in FIG. 3. The parameters used in the preferred embodiment to measure the excitation include the adaptive codebook index and gain, the fixed codebook index and gain, and the sign of the fixed codebook gain, which are all derived and updated for each subframe. The parameters are determined by using a closed loop analysis by synthesis procedure using an interpolated set of short term predictor parameters. In the preferred embodiment, the interpolation is done in the autocorrelation lag domain.

The adaptive codebook, which is a collection of past excitation samples, is searched using a target vector derived from the speech samples of that subframe. In the preferred embodiment, the search range is restricted to a six-bit range derived from the quantized open loop pitch estimates for the Mode A signal. A trade off between pitch resolution and dynamic range is carried out in much the same way as described in the earlier cited paper of K. Swaminathan et al., "Speech and Channel Codec Candidate for the Half Rate Digital Cellular Channel." Once the search range and resolution are determined, the search is carried out in the same way as is prescribed by the U.S. Federal Standard 1016 4800 bps codec, as explained in J. P. Campbell, Jr. et al., "The Proposed Federal Standard 1016 4800 bps Voice Coder Codec," Speech Technology, April/May 1990. The selected adaptive codebook index is encoded with six bits and its gain is quantized using three bits. At the end of the search, the quantized optimum adaptive codebook gain and the optimum adaptive codebook vector are used to derive the target vector for the fixed codebook search.

Figure 12:
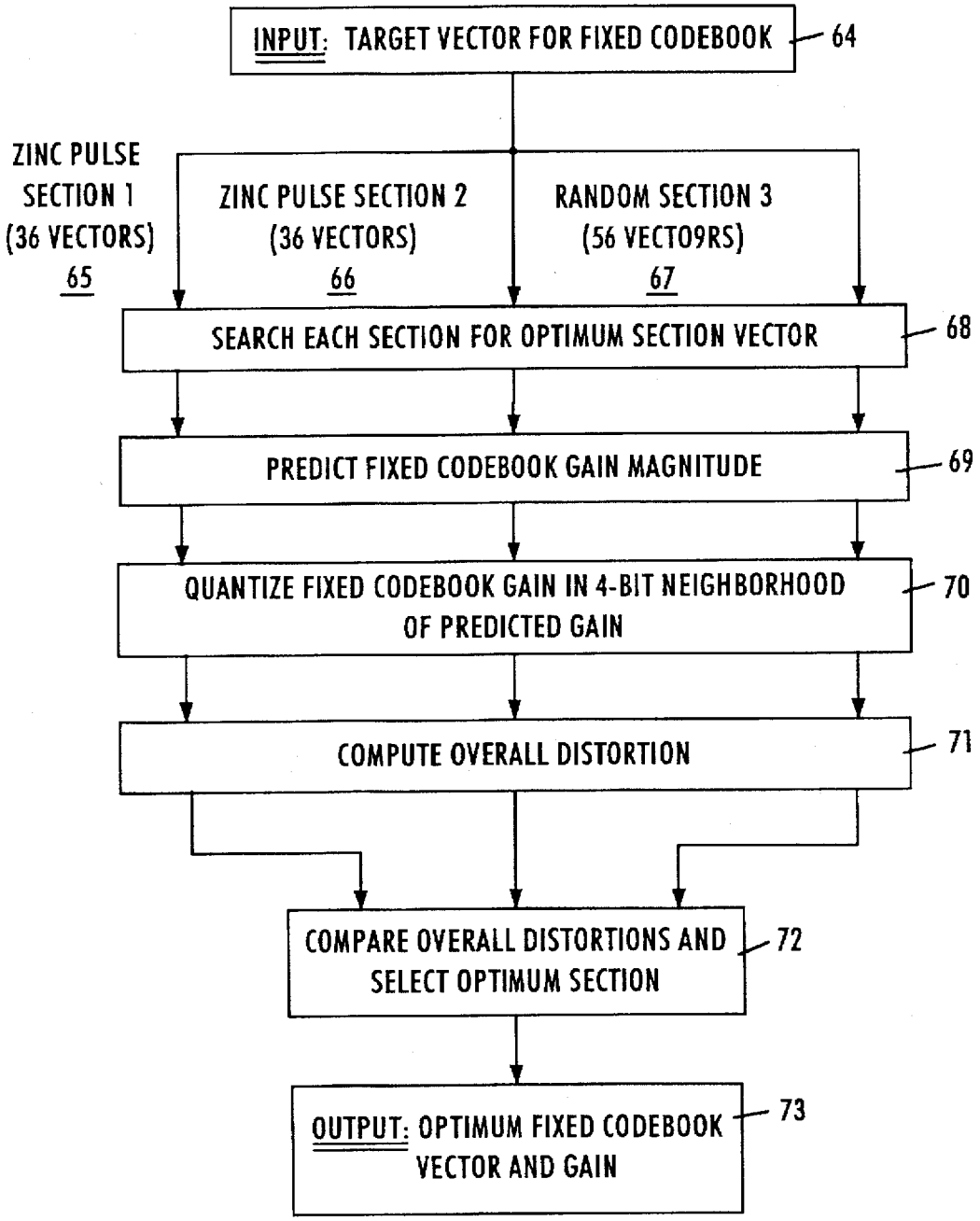
FIG. 12 illustrates the fixed codebook search and gain quantization using backward prediction in Mode A.

FIG. 12 illustrates a flowchart of fixed codebook search and gain quantization. The preferred embodiment of the present invention provides a multi-innovation codebook as the fixed codebook for Mode A, which is comprised of a total of 128 vectors. The fixed codebook is divided into three sections: two correspond to zinc pulse sections are each comprised of 36 vectors 65, 66; a third corresponds to a random section and is comprised of 56 vectors 67. Such sections are known in the prior art: Zinc pulse codebooks and corresponding codebook searches are described in D. Lin, "Ultra-fast CELP Coding Using Deterministic Multi-Codebook Innovations," presented at an IEEE workshop on speech coding held in Whistler, Canada in 1991. Random codebooks and corresponding codebook searches are used in the U.S. Federal Standard 1016 4800 bps codec.

The fixed codebook search used in the preferred embodiment takes advantage of the sparsity and overlapping nature that are common attributes of all three sections. Using techniques introduced in the prior art cited above and as briefly summarized in FIG. 12, the optimum fixed codebook vector is determined for each section 68.

The optimum fixed codebook gain is quantized in the present invention in a novel and efficient manner through selective use of backward prediction. The first step in the gain magnitude quantization for each fixed codebook section is its prediction based on the root mean square ("rms") value of the optimum fixed codebook vectors selected in the previous subframes 69. This prediction process is carried out in exactly the same manner as in the CCITT G.728 16 kbps standard codec. The predicted rms value is then used to derive a predicted fixed codebook magnitude gain for each section by normalizing it by the rms value of its optimum codebook vector. The predicted fixed codebook gain magnitude for each section is then quantized 70 by selecting from a 5-bit quantization table provided for each section, a 4-bit range determined such that the predicted gain is approximately at its center.

Having computed the optimum codebook vector and gain for each section, the overall distortion in the form of a perceptually weighted mean square error energy is determined for each section 71. The optimum section is chosen as the one which produces the least distortion 72, and the corresponding codebook vector and gain associated with that section are selected as the fixed codebook vector and the fixed codebook gain for that subframe 73. In the preferred embodiment, and as shown in FIG. 14, in Mode A, the fixed codebook index is encoded using seven bits, the fixed codebook gain is encoded using four bits, and one bit is used to encode the sign of the gain.

If the signal frame being analyzed is classified as unvoiced or nonstationary speech (Mode B), the preferred embodiment analyzes the excitation of the frame in four equal subframes, each having a duration of 5.625 msec, as shown in FIG. 3. As in Mode A, the excitation parameters include the adaptive codebook index, the adaptive codebook gain, the fixed codebook index, and the fixed codebook gain, and each of these parameters are determined in each subframe by a closed loop analysis by synthesis procedure using an interpolated set of short term predictor parameters. The interpolation is again done in the autocorrelation lag domain, but with different interpolation weights.

In Mode B, the adaptive codebook search is carried out for all integer pitch delays that span a 7-bit range from 20 to 147. The search procedure is the same as in the U.S. Federal Standard 1016 4800 bps codec: no restricted search range or fine pitch resolution are employed, as they are in Mode A, and the open loop pitch estimates are thus not used. The adaptive codebook index is encoded using seven bits and its gain using three bits, as indicated in FIG. 15.

The fixed codebook in Mode B is similar to that used in Mode A, although it contains more vectors: the two zinc pulse sections each contain 64 vectors and the random section contains 128 vectors. Once the optimum vectors in each section are determined, it is possible to employ backward prediction to estimate the fixed codebook gain magnitude in the same manner as in Mode A. However, because Mode B frames are often nonstationary and can potentially contain transient speech segments such as plosive sounds, the gain magnitude predicted by backward prediction is often inaccurate. Thus, backward prediction can lead to serious errors unless employed in a considerably restricted manner, which would consequently restrict its benefits. For this reason, in the preferred embodiment of the present invention, backward prediction of gain magnitude is not used. Rather, the gain magnitude for each section is quantized using a 4-bit quantizer for that section. The section producing the least distortion is the one selected as the optimum section, and the corresponding vector index is selected as the fixed codebook index and encoded using eight bits, its gain magnitude is encoded using four bits, and the gain sign is encoded using one bit, as shown in FIG. 15.

Finally, the preferred embodiment of the present invention analyzes the excitation of signal frames classified as background noise (Mode C) in four equal subframes, as with Mode B subframes, each having a duration of 5.625 msec as shown in FIG. 3. As with both Mode A and Mode B analysis, an interpolated set of short term predictor parameters are used for the closed loop excitation analysis. The interpolation again takes place in the autocorrelation lag domain, but with interpolating weights unique to this mode. The adaptive codebook search is the same as in Mode B, but both positive and negative correlations are searched. This is because for background noise (Mode C), the adaptive codebook is treated much like the fixed codebook. As a result, the adaptive codebook gain can be either negative or positive. Thus, seven bits are used to encode the adaptive codebook index, three for the adaptive codebook gain magnitude, and one for its sign, as is shown in FIG. 16.

Figure 13:
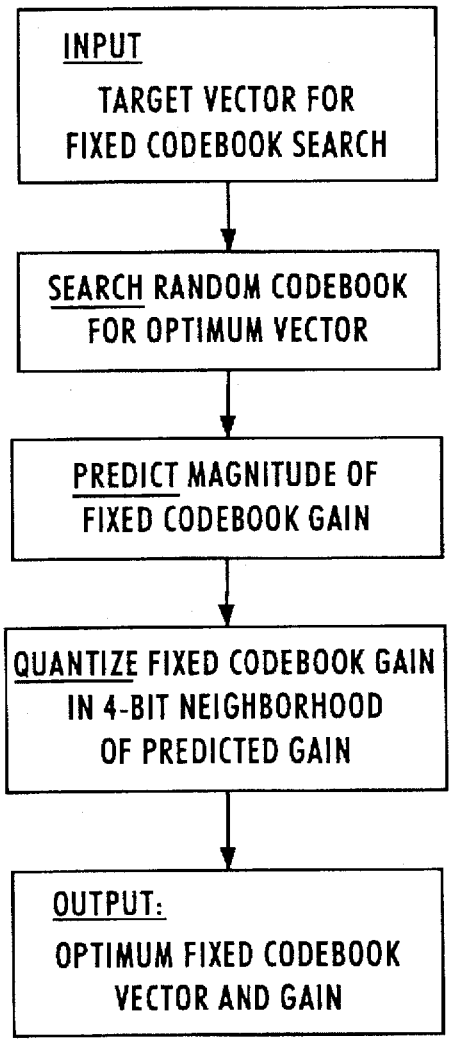
FIG. 13 illustrates the fixed codebook search and gain quantization using backward prediction in Mode C.

Since zinc pulse sections do not model background noise very well, the fixed codebook used to model a Mode C signal consists only of a random section. However, the gain magnitude can be obtained by backward prediction by the same process described above with respect to Mode A signals. FIG. 13 shows a flowchart of this process. The fixed codebook index is encoded using seven bits, the gain magnitude is encoded using four bits, and its sign, using one bit, also shown in FIG. 16.

The bit allocations for all the parameters in Modes A, B and C are illustrated in FIGS. 14, 15 and 16 respectively. Although the allocations for specific parameters may differ between the different modes, the total number of bits to represent a 22.5 msec frame is 128, resulting in a total bit rate of 5.69 kbps.

Of course, it should be understood that a wide range of changes and modifications can be made to the preferred embodiment described above. It is therefore intended that the foregoing detailed description be regarded as illustrative rather than limiting and that it be understood that it is the following claims, including all equivalents, which are intended to define the scope of this invention.

What is claimed is:

1. A method of coding a digitized speech signal comprising the steps of:

analyzing the digitized speech signal in discrete segments;

classifying each discrete segment of the digitized speech signal in one of a plurality of predetermined modes comprising a first mode and a second mode;

determining a set of unquantized line spectral frequencies for each discrete segment of the digitized speech signal to represent short term predictor parameters for the digitized speech signal segment;

quantizing each unquantized line spectral frequency in each determined set of unquantized line spectral frequencies representing discrete segments of the digitized speech signal classified in the first mode; and encoding the unquantized line spectral frequencies in each set of unquantized line spectral frequencies representing discrete segments of the digitized speech signal classified in the second mode using at least one offset generated from analysis of a representation of at least one preceding discrete segment of the digitized speech signal.

2. The coding method according to claim 1 further comprising the step of providing at least one set of scalar quantizers to scalar quantize a first subset of the determined set of unquantized line spectral frequencies.

3. The coding method according to claim 2, wherein a set of scalar quantizers trained on IRS-filtered speech is provided.

4. The coding method according to claim 2, wherein a set of scalar quantizers trained on unfiltered speech is provided.

5. The coding method according to claim 2, wherein the second mode is a voiced mode for classifying digitized speech signal segments containing voiced speech, and wherein, for each unquantized line spectral frequency in the first subset of unquantized line spectral frequencies for a digitized speech signal classified in the voiced mode, the line spectral frequency encoding step comprises the step of:

predicting each line spectral frequency as a weighted sum of neighboring line spectral frequencies scalar quantized for a preceding digital speech signal segment such that a respective offset is generated for each such line spectral frequency from the corresponding weighted sum of quantized neighboring line spectral frequencies.

6. The coding method according to claim 1, further comprising the step of providing a vector quantization table having entries of vectors for vector quantizing a second subset of the determined set of unquantized line spectral frequencies, wherein a vector entry is accessed as a series of bits representing an index into the vector quantization table, and wherein the vector entries are arranged in the vector quantization table such that a change in a nth least significant bit of an index $i_1$ corresponding to a vector entry $v_1$ results in an index $i_2$ corresponding to a vector entry $v_2$ that is one of $2^n$ vector entries closest to the vector entry $v_1$.

7. The coding method according to claim 6, wherein the vector quantization table is trained on IRS-filtered speech.

8. The coding method according to claim 6, wherein the vector quantization table is trained on unfiltered speech.

9. The coding method according to claim 6, wherein the second mode is a voiced mode for classifying digitized speech signal segments containing voiced speech, and wherein, for each vector quantization table, and for a digitized speech signal segment classified in the voiced mode, the coding method further comprises the steps of:

determining a range of indices representing vectors in the vector quantization table for vector quantizing the second subset of unquantized line spectral frequencies, depending on line spectral frequencies vector quantized for a preceding digitized speech signal segment;

selecting a vector having an index in the determined range of indices for vector quantizing the second subset of the determined set of unquantized line spectral frequencies; and encoding the selected vector as an offset within the determined range of indices.

10. The coding method according to claim 1 wherein the first mode is a non-voiced mode for classifying digitized speech signals not primarily containing voiced speech, and wherein, for a digitized speech signal classified in the non-voiced mode, the coding method further comprises the steps of:

providing a first set of scalar quantizers trained on IRS-filtered speech and a second set of scalar quantizers trained on unfiltered speech to scalar quantize a first subset of the determined set of unquantized line spectral frequencies;

providing a first vector quantization table trained on IRS-filtered speech and a second vector quantization table trained on unfiltered speech, wherein each vector quantization table has entries of vectors for vector quantizing a second subset of the determined set of unquantized line spectral frequencies;

determining a first set of quantized line spectral frequencies by scalar quantizing the first subset of unquantized line spectral frequencies with the first set of scalar quantizers and vector quantizing the second subset of unquantized line spectral frequencies with the first vector quantization table;

determining a second set of quantized line spectral frequencies by scalar quantizing the first subset of unquantized line spectral frequencies with the second set of scalar quantizers and vector quantizing the second subset of unquantized line spectral frequencies with the second vector quantization table;

measuring the cepstral distortion between the first set of quantized line spectral frequencies and the determined set of unquantized line spectral frequencies, and between the second set of quantized line spectral frequencies and the determined set of unquantized line spectral frequencies; and selecting the set of quantized line spectral frequencies having the smaller measured cepstral distortion for representing the short term predictor parameters for the digitized speech signal segment.

11. The coding method according to claim 1, further comprising the step of analyzing at least one of:

a spectral stationarity in the digitized speech signal segment;

a pitch stationarity in the digitized speech signal segment;

a zero crossing rate in the digitized speech signal segment;

a short term level gradient in the digitized speech signal segment; and a short term energy in the digitized speech signal segment;

wherein the classifying step depends on the results of the analyzing step.

12. A method of decoding a data bitstream containing encoded parameters for a segment of a digitized speech signal comprising the steps of:

extracting from the data bitstream: a mode parameter encoding a mode of the digitized speech signal segment, a set of scalar quantizer parameters, and a vector quantizer parameter;

classifying the digitized speech signal segment in one of a plurality of predetermined modes based on the extracted mode parameter, the plurality of predetermined modes comprising a first mode and a second mode;

determining a set of inverse quantized line spectral frequencies for the digitized speech signal segment by determining a first subset of inverse quantized line spectral frequencies based on the extracted set of scalar quantizer parameters, and determining a second subset of inverse quantized line spectral frequencies based on the extracted vector quantizer parameter, wherein the set of scalar quantizer parameters and the vector quantizer parameter, for digitized speech signal segments classified in the second mode, represent a set of offsets generated through backward prediction from analysis of a preceding digitized speech signal segment.

13. The decoding method according to claim 12, wherein:

the second mode is a voiced mode wherein, for a digitized speech signal segment classified in the voiced mode, the step of determining the first subset of inverse quantized line spectral frequencies comprises, for each member of the first subset, the steps of:

predicting a line spectral frequency as a weighted sum of neighboring scalar quantized line spectral frequencies determined for a preceding digitized speech signal segment; and determining the inverse quantized line spectral frequency based on the predicted line spectral frequency and a corresponding scalar quantizer parameter from the set of scalar quantizer parameters, which encodes an offset from the predicted line spectral frequency.

14. The decoding method according to claim 12, wherein:

the second mode is a voiced mode wherein, for a digitized speech signal segment classified in the voiced mode, the step of determining the second subset of inverse quantized line spectral frequencies comprises the steps of:

providing a vector quantization table, having entries of vectors accessed by indices into the vector quantization table;

determining a range of indices of the vector quantization table representing a range of vectors, based on vector quantized line spectral frequencies determined for preceding digitized speech signal segment; and determining the vector selected for the second subset of inverse quantized line spectral frequencies, based on the determined range of indices and the vector quantizer parameter, which encodes an offset in the determined range of indices.

15. A coder for encoding a segment of a digitized speech signal comprising:

a mode classifier for classifying the digitized speech signal segment in one of a plurality of predetermined modes comprising a first mode and a second mode;

a determinator section for determining a set of unquantized line spectral frequencies to represent short term predictor parameters for the digitized speech signal segment;

a quantizer section for quantizing the determined set of unquantized line spectral frequencies representing digitized speech signal segments classified in the first mode; and an encoder section for encoding the determined set of unquantized line spectral frequencies representing digitized speech signal segments classified in the second mode using at least one offset generated from analysis of a representation of at least one preceding discrete digitized speech signal segment.

16. The coder according to claim 15, wherein the quantizer section includes a scalar quantizer section that quantizes a first subset of the unquantized line spectral frequencies using at least one set of scalar quantizer elements.

17. The coder according to claim 16, wherein a set of scalar quantizer elements trained on IRS-filtered speech is used.

18. The coder according to claim 16, wherein a set of scalar quantizer elements trained on unfiltered speech is used.

19. The coder according to claim 16, wherein the second mode is a voiced mode, in which the mode classifier classifies a digital speech signal segment containing voiced speech, and wherein the coder further comprises:

a memorizer section for memorizing line spectral frequencies quantized by the scalar quantizer section; and a predictor section for predicting each line spectral frequency for each of a subset of unquantized line spectral frequencies for a digitized speech signal segment classified in the voiced mode as a weighted sum of neighboring line spectral frequencies scalar quantized for a preceding digitized speech signal segment and memorized by the memorizer section;

wherein an offset for each of the first subset of unquantized line spectral frequencies is generated from the corresponding predicted line spectral frequency.

20. The coder according to claim 15, wherein a vector quantizer section quantizes a second subset of the unquantized line spectral frequencies using a vector quantization table section having entries of vectors accessed as a series of bits representing an index to the vector quantization table section, and wherein the vector entries are arranged in the vector quantization table section such that a change in the nth least significant bit of an index $i_1$ corresponding to a vector $v_1$ results in an index $i_2$ corresponding to a vector $v_2$ that is one of the $2^n$ vectors closest to the vector $v_1$, where closeness is measured by the norm distance metric between the vectors $v_1$ and $v_2$.

21. The coder according to claim 20, wherein the vector quantization table section is trained on IRS-filtered speech.

22. The coder according to claim 20, wherein the vector quantization table section is trained on unfiltered speech.

23. The coder according to claim 20, wherein the second mode is a voiced mode, in which the mode classifier classifies a digital speech signal segment containing voiced speech, further comprising:

a memorizer section for memorizing the line spectral frequencies quantized by the vector quantizer section;

a range determinator section for determining a range of indices representing vectors in the vector quantization table section for each of a subset of unquantized line spectral frequencies for a digitized speech signal segment classified in the voiced mode, depending on line spectral frequencies vector quantized for a preceding digitized speech signal segment and memorized by the memorizer section; and a selector section for selecting a vector having an index within the determined range of indices, for vector quantizing the second subset of unquantized line spectral frequencies;

wherein an offset is generated from the index of the selected vector.

24. The coder according to claim 15, wherein:

the first mode is a non-voiced mode for classifying digitized speech signals not primarily containing voiced speech;

the quantizer section includes a scalar quantizer section that quantizes a first subset of the unquantized line spectral frequencies using a first set of scalar quantizer elements trained on IRS-filtered speech and a second set of scalar quantizer elements trained on unfiltered speech;

the quantizer section includes a vector quantizer section that quantizes a second subset of the unquantized line spectral frequencies using a first vector quantization table section trained on IRS-filtered speech and a second vector quantization table section trained on unfiltered speech; and wherein the coder further comprises:

a first quantized set determinator section for determining a first set of quantized line spectral frequencies by scalar quantizing the first subset of unquantized line spectral frequencies with the first set of scalar quantizer elements and vector quantizing the second subset of unquantized line spectral frequencies with the first vector quantization table section;

a second quantized set determinator section for determining a second set of quantized line spectral frequencies by scalar quantizing the first subset of unquantized line spectral frequencies with the second set of scalar quantizer elements and vector quantizing the second subset of unquantized line spectral frequencies with the second vector quantization table section;

a measurer section for measuring the cepstral distortion between the first set of quantized line spectral frequencies and the determined set of unquantized line spectral frequencies, and between the second set of quantized line spectral frequencies and the determined set of unquantized line spectral frequencies;

a selector section for selecting the set of quantized line spectral frequencies having the smaller measured cepstral distortion for representing the short term predictor parameters for the digitized speech signal segment.

25. The coder according to claim 15, further comprising an analyzer section, wherein the mode classifier classifies the digitized speech signal segment based on the analysis of the analyzer section, wherein the analyzer section analyzes at least one of:

a spectral stationarity of the digitized speech signal segment;

a pitch stationarity of the digitized speech signal segment;

a zero crossing rate of the digitized speech signal segment;

a short term level gradient of the digitized speech signal segment; and a short term energy of the digitized speech signal segment.

26. A decoder for decoding a data bitstream containing encoded parameters for a segment of a digitized speech signal comprising:

an extractor section for extracting from the data bitstream: a mode parameter encoding a mode of the digitized speech signal segment, a set of scalar quantizer parameters, and a vector quantizer parameter;

a mode classifier for classifying the digitized speech signal segment in one of a plurality of predetermined modes based on the extracted mode parameter, the plurality of predetermined modes comprising a first mode and a second mode; and a determinator section for determining a set of inverse quantized line spectral frequencies, comprised of a scalar quantized set determinator section for determining a first subset of inverse quantized line spectral frequencies based on the extracted set of scalar quantizer parameters, and a vector quantized set determinator section for determining a second subset of inverse quantized line spectral frequencies based on the extracted vector quantizer parameter, wherein the extracted set of scalar quantizer parameters and the extracted vector quantizer parameter, for digitized speech signal segments classified in the second mode, represent a set of offsets generated through backward prediction from analysis of a preceding digitized speech signal segment.

27. The decoder according to claim 26, wherein the second mode is a voiced mode, and wherein the decoder further comprises:

a memorizer section for memorizing line spectral frequencies determined by the scalar quantized set determinator section; and wherein the scalar quantized set determinator section further comprises:

a predictor section for predicting a line spectral frequency for each of a first subset of inverse quantized line spectral frequencies for a digitized speech signal segment classified in the voiced mode, as a weighted sum of neighboring line spectral frequencies scalar quantized for a preceding digitized speech signal segment and memorized by the memorizer section; and a scalar quantizer section for determining each inverse quantized line spectral frequency for a digitized speech signal segment classified in the voiced mode, based on the predicted line spectral frequency and the extracted scalar quantizer parameter, which encodes an offset from the predicted line spectral frequency.

28. The decoder according to claim 26, wherein the second mode is a voiced mode, and wherein the decoder further comprises:

a vector quantization table section, having entries of vectors, accessed by indices into the vector quantization table section;

a memorizer section for memorizing line spectral frequencies determined by the vector quantized set determinator section; and a range determinator section for determining for a digitized speech signal segment classified in the voiced mode, a range of indices representing vectors in the vector quantization table section, depending on the vector quantized line spectral frequencies determined for a preceding digitized speech signal segment and memorized by the memorizer section;

a vector determinator section for determining the vector selected for the vector quantized set of inverse quantized line spectral frequencies, based on the determined range of indices and the vector quantizer parameter, which encodes an offset in the determined range of indices.

* * * * *